US005225075A

United States Patent [19]

Cunningham

[11] Patent Number: 5,225,075

[45] Date of Patent: Jul. 6, 1993

[54] SWIMMING POOL SKIMMER WINTERIZING PLUG

[76] Inventor: Philip J. Cunningham, 54 Edenmills Dr., West Hill, Ontario, Canada, M1E 4L2

[21] Appl. No.: 898,671

[22] Filed: Jun. 15, 1992

[51] Int. Cl.[5] ..... E04H 4/14

[52] U.S. Cl. ..... 210/169; 138/27; 4/496; 4/512

[58] Field of Search ..... 210/169, 416.2; 138/27, 138/90, 89; 220/241, 242, 378; 137/301; 4/494, 496, 507, 508, 512

[56] References Cited

U.S. PATENT DOCUMENTS

| | | | |
|---|---|---|---|
| 4,281,422 | 8/1981 | Simonelli | 4/496 |
| 4,368,550 | 1/1983 | Stevens | 4/507 |
| 4,561,134 | 12/1985 | Mathews et al. | 4/496 |
| 4,752,979 | 6/1988 | Goacher, Sr. | 4/496 |
| 4,808,081 | 2/1989 | Finley | 4/507 |

*Primary Examiner*—Peter Hruskoci
*Assistant Examiner*—Robert James Popovics

[57] ABSTRACT

A winterizing plug for water lines of a swimming pool is disclosed. The winterizing plug cooperates with a port in the skimmer to displace water in the line and reduce the possibility of damage thereto. Water is displaced by means of air pressure maintained within the line.

6 Claims, 3 Drawing Sheets

SWIMMING POOL SKIMMER WINTERIZING PLUG

FIELD OF THE INVENTION

The present invention relates to swimming pools and in particular to a winterizing plug assembly for protecting water lines associated with skimmers.

BACKGROUND OF THE INVENTION

Swimming pools subject to winter conditions are winterized to avoid damage to pipes caused when the water freezes.

Part of the winterizing process is to lower the level of the water within the pool and to drain various piping used in the circulation and heating system, such as from the filter and heater. Some of the pipes cannot be fully drained, for example, skimmers used in swimming pools have one line which is connected to the drain of the pool and the level of water within this line drops with, and is equal to, the level of water in the pool. By dropping the pool water level, the water in the pipe is lowered, however, it is desirable to maintain a certain amount of water in the pool to avoid inward collapsing of the pool, during a frost push, for example. With a lower pool level, damage can occur in the pipe connecting the skimmer to the drain. If damage does occur in this pipe, access to the pipe must be obtained and a replacement pipe inserted. This can be a substantial problem with respect to inground pools and can be relatively expensive to repair.

SUMMARY OF THE INVENTION

The present invention provides a simple method and a winterizing plug assembly to overcome the problem described above. In a swimming pool having a skimmer located for removal of water at the surface of the pool and having a water line connected thereto which extends downwardly to the drain of the pool, a winterizing plug assembly cooperates and seals with the skimmer where the water line connects to the skimmer. The plug assembly has valve means for introducing and maintaining air under pressure to the water line whereby water within the line may be displaced downwardly and exhausted through the drain to the swimming pool by introducing air under pressure to the line through the valve means. This air is held under pressure by the valve means. The introduction of pressurized air lowers the water within the pipe and marginally raises the level of the pool due to the amount of water displaced from the pipe. By maintaining the air pressure, the water within the pipe is at a level below the level of the pool.

From the above, it can be appreciated that the winterizing plug assembly allows for the water within the line to be exhausted, or partially exhausted, with the air pressure and the head of water remaining in the pipe being equal to the pressure exerted by the head of water in the pool.

According to an aspect of the invention, the plug assembly includes a compressible member extending from the bottom of the plug assembly and of a size to be received in the water line. The compressible member is elongate and of a length of preferably at least 20 inches. This member readily yields to dissipate expansion forces exerted thereon by ice. This compressible member provides a further means for reducing the possibility of damage to the pipe, even if the water within the pipe returns to the level of the pool. Any expansion forces exerted by the frozen water in the pipe can be at least partially absorbed by this compressible member whereby the force on the pipe, tending to burst the pipe, is reduced.

According to yet a further aspect of the invention, the compressible member is a tube sealed at one end to the plug assembly with the valve means connected to allow air to pass into the tube. The tube at the opposite end of the valve means is open whereby a pressurized air column may be produced in the water line by introducing pressurized air through the valve means into the water line. The tube is separately sealed to the plug assembly, such that even if leakage occurs between the skimmer and the plug raising the water level in the water line to cover the end of the tube, a pressurized column of air will be maintained within the tube. This pressurized column of air will be maintained as long as the valve means continues to form a seal.

According to yet a further aspect of the invention, the compressible member is a rubber hose.

According to yet a further aspect of the invention, the winterizing plug has a screw thread on the exterior thereof which cooperates with a threaded port in the skimmer to which the water line is connected. The threaded plug forms a seal with the threaded port of the skimmer.

The present invention is also directed to a method of reducing the risk of damage by freezing of a water line wherein the water line is associated with a drain of a swimming pool and a skimmer, serving to connect the skimmer to the drain in the bottom of the pool. The method comprises opening the drain to allow the water in the water line to be subject to the pressure exerted by the head of water in the pool, sealing the water line adjacent the skimmer, introducing pressurized air into the water line while maintaining the seal at the skimmer to thereby displace water in the water line to a level below the water level in the pool.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
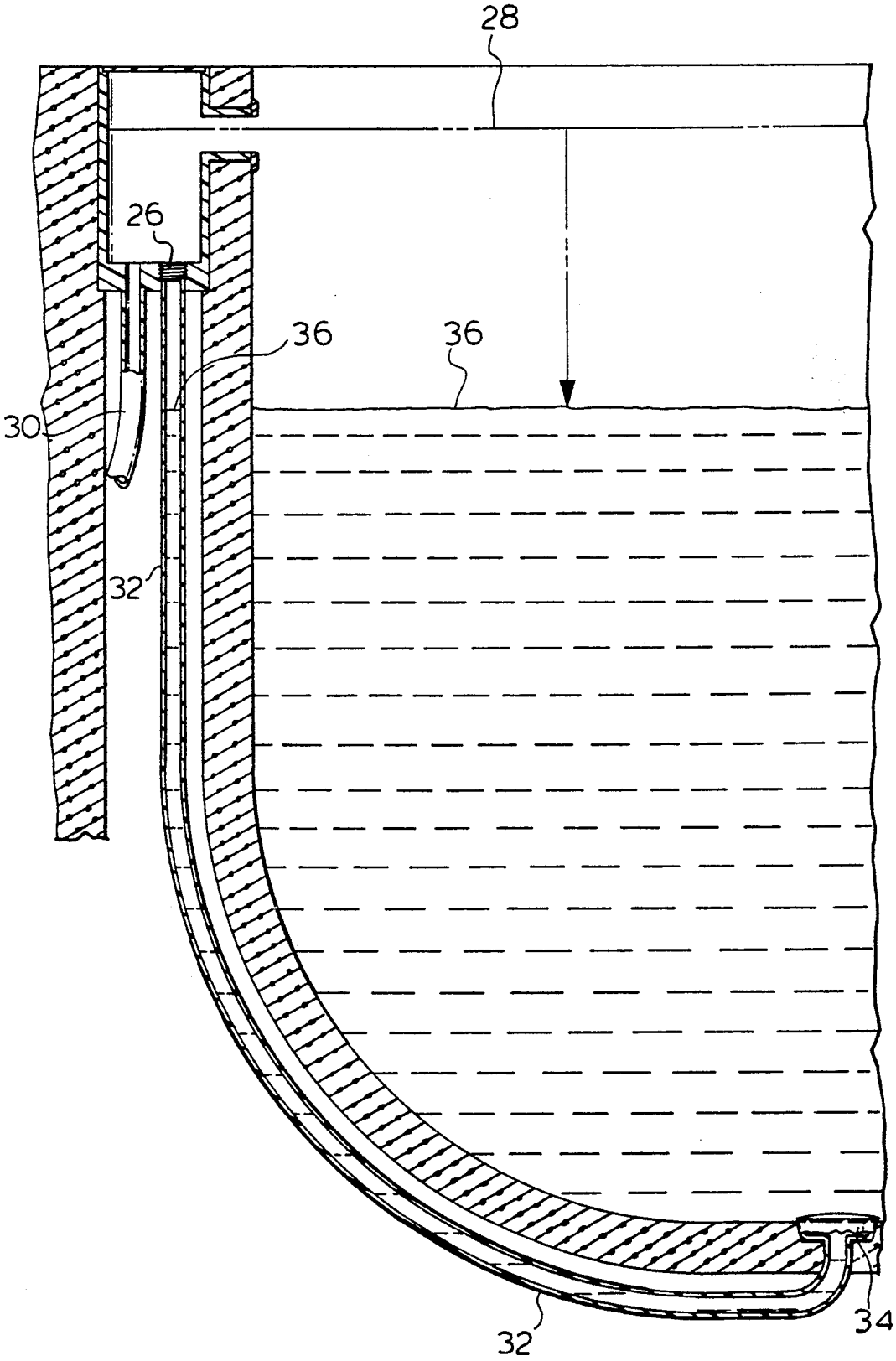
FIG. 1 is sectional view showing a portion of a swimming pool and skimmer, with a water line connecting the skimmer with the drain of the pool.
Figure 2:
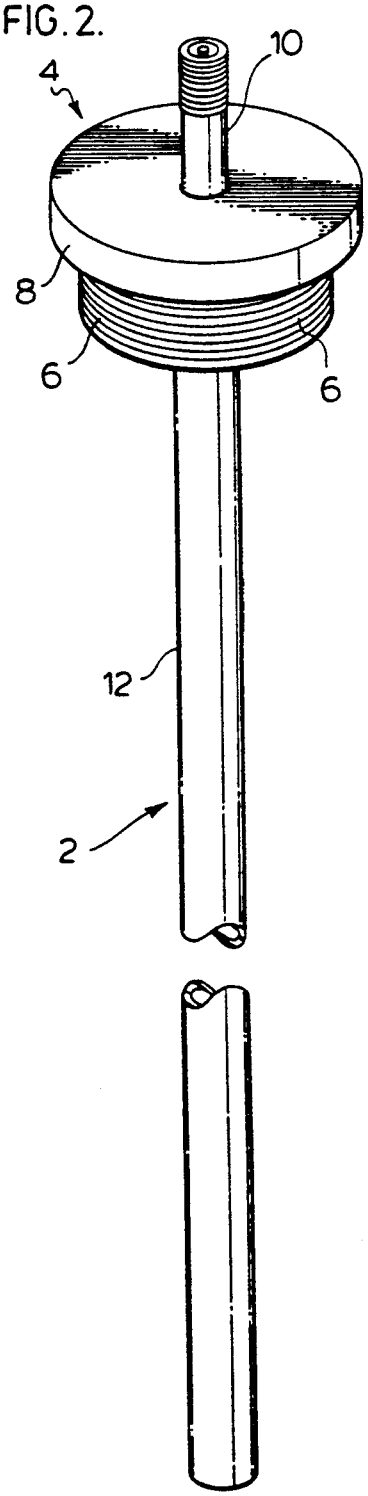
FIG. 2 is a partial perspective view of the winterizing plug assembly.

The winterizing plug assembly 2 includes a threaded plug 4 for receipt in the threaded port of a skimmer. The plug includes exterior threads 6 extending below a collar 8. The plug includes an air valve 10 through which air can be introduced through the plug, which air is discharged into the downwardly extending flexible tube or hose 12. The flexible tube or hose is preferably of a length of at least about 20 inches. The tube 12 is of a diameter less 0 than the diameter of the various water lines in a swimming pool and in particular, is less than the diameter of the line 32 connected to the drain of the pool and to the skimmer of the pool, generally shown as 22.

Figure 3:
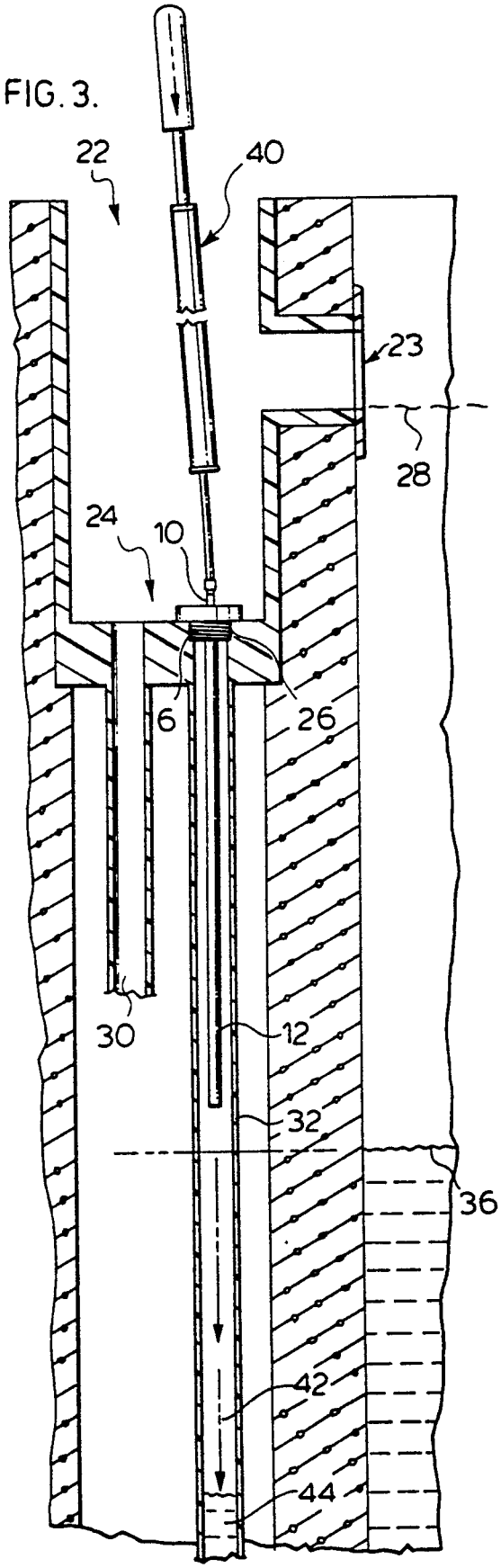
FIG. 3 is a partial cross sectional view showing the plug assembly inserted in the skimmer and connecting to the water line.

The swimming pool 20 has a skimmer 22 in a side wall of the pool. During normal operation of the pool, the skimmer mouth 23 has a lower edge slightly below the normal level in the pool, which level is indicated as 28. To winterize the pool, the water level is typically dropped to a level indicated as 36 in FIG. 3. By dropping the pool level to this point, the water within the line 32 connecting the skimmer 22 with the main drain 34 of the pool drops to the same point, i.e. level 36. Unfortunately, freezing and resultant damage can still occur in this line. The water level in the pool could further be lowered, however, from a practical point of view, there is a rationale for having the level 36 fairly close to the normal operating level 28 to avoid buckling of the pool walls. Typically, the level in the pool is dropped to below the ceramic tiles, as damage to the tiles can occur if the tiles remain submerged at the winter level 36.

In order to drop the level in line 32, the winterizing plug assembly is threaded into threaded port 26 located in the base 24 of the skimmer 22. Also connected in the base 24 of the skimmer 22 is a line 30 which is connected to the pump and filter unit of the pool. During the winterizing step, the drain 34 is open and the winterizing plug assembly 2 is inserted in the skimmer in the manner shown in FIG. 3. An air pump 40 is connected to the air valve 10 and air is forced through the air valve under pressure into line 32. The air is initially discharged through the tube 12. Air is forced into line 32 causing the air pressure in line 32 to increase. This air pressure will force the level of water in line 32 to be lowered to a level generally indicated as 44. As can be seen, level 44 is below the winterizing level 36 of the pool. The water forced from line 32 is being discharged through the drain 34 into the pool. In this way, line 32 has been cleared adjacent the winter level 36 of the pool, such that the pipe is less vulnerable to damage. The level 44 within the line 32 is determined according to the air pressure within line 32 and the head of water in the pool determined by the level 36. In this way, the user can depress the level of water in the line 32 and reduce the possibility of damage to the line 32.

Figure 4:
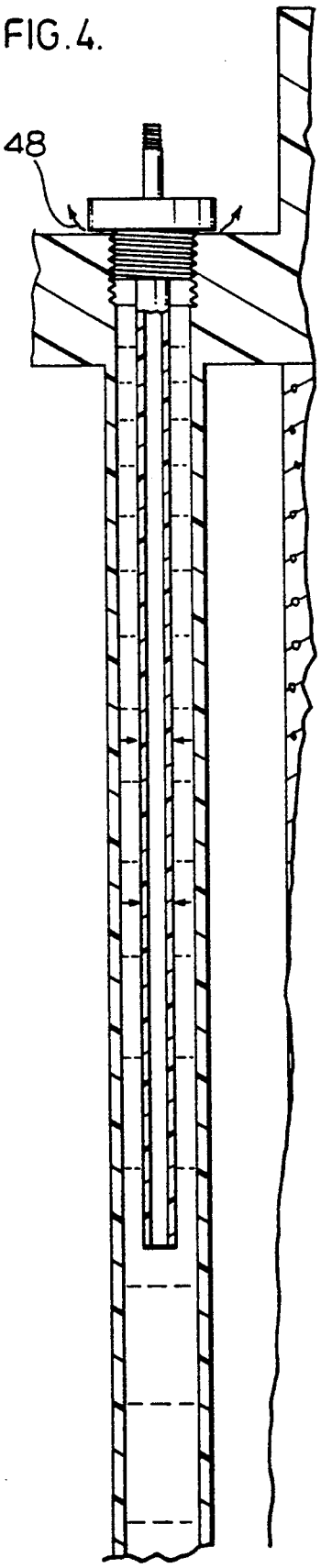
FIG. 4 is a sectional view showing the winterizing plug in the skimmer wherein the seal between the skimmer and the plug has failed.

The winterizing plug 2 also has a number of benefits, even if the seal or the valve stem fails. For example, in FIG. 4, it is shown that the seal between the plug 2 and the skimmer base 24 has failed and air can leak out, as indicated at 48. In this case, water can rise up to the exterior of tube 12, however, it cannot be discharged through tube 12 due to the fact that the valve 10 is still forming an air seal. In this way, there is still a compressed column of air within the tube 12 and this tube can accommodate movement to accommodate any ice expansion within the line 32.

Figure 5:
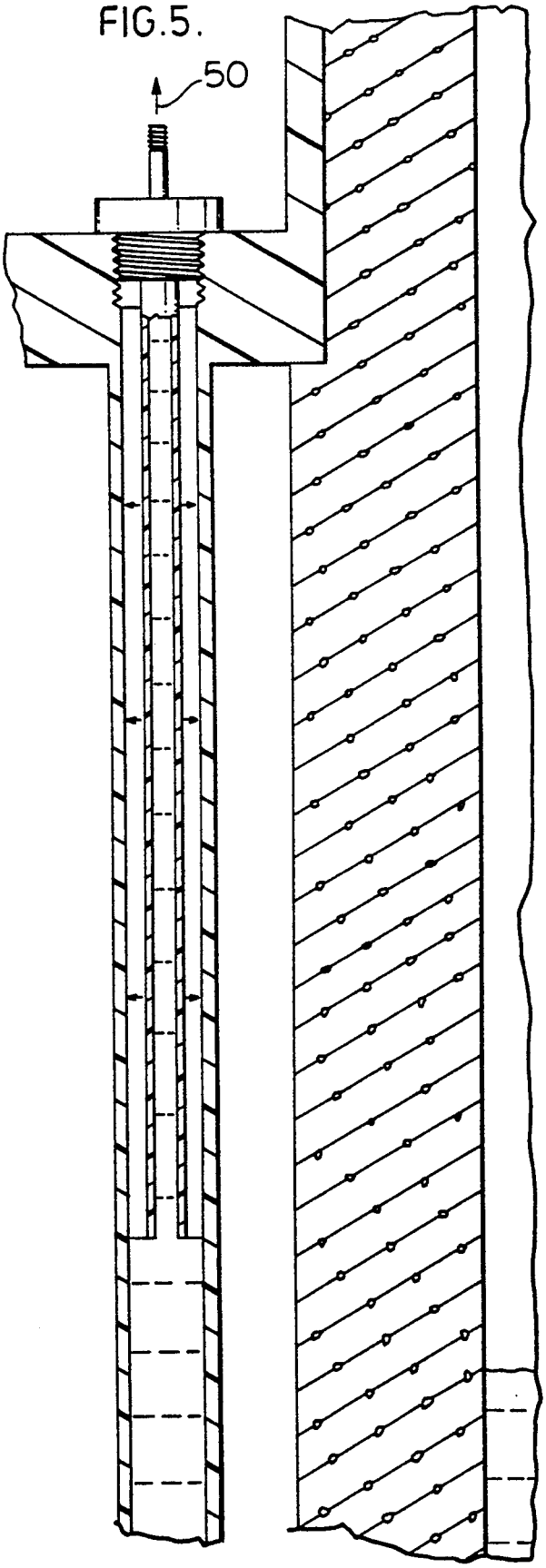
FIG. 5 is a sectional view through the pool showing the skimmer and plug assembly where the valve means has failed.

In FIG. 5, it it shown that the valve 10 could fail, however, in this case, a seal is still maintained to the exterior of the tube 12. Therefore, water within the tube can expand against the tube 12 and may cause damage to tube 12, however, there is still a degree of protection for line 32 which is superior to the normal winterizing condition.

Although various preferred embodiments of the present invention have been described herein in detail, it will be appreciated by those skilled in the art, that variations may be made thereto without departing from the spirit of the invention or the scope of the appended claims.

I claim:

1. In a swimming pool having a skimmer located for removal of water at a water surface of the pool, said skimmer having a waterline connected thereto which extends downwardly to the drain of the pool, a winterizing plug assembly which cooperates and seals with said skimmer where said waterline connects to said skimmer, said plug assembly having valve means for introducing and maintaining air under pressure to said waterline wherein water within the line may be displaced downwardly and exhausted through said drain to the swimming pool by introducing air under pressure to said line through said valve means which air is held under pressure by said valve means, and wherein said plug assembly includes an elongate compressible member extending from the bottom of said plug assembly and of a size to be received in the waterline, said compressible member readily yielding to dissipate expansion forces exerted thereon by ice.

2. In a swimming pool as claimed in claim 1 wherein said compressible member is of a length of at least 20 inches.

3. In a swimming pool as claimed in claim 1 wherein said compressible member is a tube sealed to said plug assembly with said valve means connected to allow air to pass into said tube, said tube at the end opposite said valve means being open.

4. In a swimming pool as claimed in claim 3 wherein said tube is a rubber hose.

5. In a swimming pool as claimed in claim 4 wherein said winterizing plug has a screw thread on the exterior thereof for cooperating with threaded port in said skimmer to which said waterline is connected.

6. In combination a swimming pool having a skimmer which is connected by a waterline to a drain in the bottom of the pool and a winterizing plug sealingly cooperating with said waterline adjacent said skimmer, said plug including an elongate compressible member extending from the bottom of the plug and of a size to be received in the water, said compressible member readily yielding to dissipate expansion forces exerted thereon by ice, said winterizing plug further including valve means through which pressurised air can enter said waterline and be retained therein due to the plug sealingly cooperating with said waterline and a pressure exerted by the head of water exerted on said waterline by the water in the pool transmitted to the waterline via the drain being open to said waterline such that air pressure introduced to said waterline via said valve displaces water in said waterline to a winter level below the water level in the pool, said winter level relative to said water level in said pool being determined by the magnitude of the air pressure introduced through said valve means.

* * * * *